US008927885B2

(12) United States Patent
Hoepfl et al.

(10) Patent No.: US 8,927,885 B2
(45) Date of Patent: Jan. 6, 2015

(54) MECHANICAL SWITCH CONTACT

(75) Inventors: Klaus Hoepfl, Maxhuette-Haidhof (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 77 days.

(21) Appl. No.: 13/638,877

(22) PCT Filed: Feb. 23, 2011

(86) PCT No.: PCT/EP2011/000854

§ 371 (c)(1), (2), (4) Date: Oct. 25, 2012

(87) PCT Pub. No.: WO2011/128012

PCT Pub. Date: Oct. 20, 2011

(65) Prior Publication Data

US 2013/0192963 A1 Aug. 1, 2013

(30) Foreign Application Priority Data

Apr. 15, 2010 (DE) ..... 10 2010 015 051

(51) Int. Cl.

| | |
|---|---|
| ***H01H 19/00*** | (2006.01) |
| ***H01H 21/00*** | (2006.01) |
| ***H01H 1/56*** | (2006.01) |
| ***H01H 9/00*** | (2006.01) |

(52) U.S. Cl.

CPC ..... *H01H 1/56* (2013.01); *H01H 9/0016* (2013.01)

USPC ..... 200/11 TC

(58) Field of Classification Search

CPC ... H01H 21/18; H01H 1/2041; H01H 1/2058; H01H 1/22; H01H 1/56; H01H 9/0027; H01H 9/0005; H01H 2009/0005; H01H 2009/0088; H01H 2205/00

USPC ..... 200/11 TC

See application file for complete search history.

(56) References Cited

U.S. PATENT DOCUMENTS

| | | | | |
|---|---|---|---|---|
| 3,632,908 | A * | 1/1972 | Bleibtreu et al. | 200/11 TC |
| 5,123,291 | A | 6/1992 | Sonntagbauer | |
| 6,008,456 | A | 12/1999 | Pillmeier | |
| 6,740,831 | B2 | 5/2004 | Baertl | |
| 7,683,282 | B2 | 3/2010 | Kloth et al. | |
| 2014/0176273 | A1 * | 6/2014 | Elick et al. | 336/150 |

FOREIGN PATENT DOCUMENTS

| | | | |
|---|---|---|---|
| DE | 1613646 | A | 5/1971 |
| EP | 0132662 | A | 2/1985 |

* cited by examiner

*Primary Examiner* — Renee Luebke
*Assistant Examiner* — Anthony R. Jimenez
(74) *Attorney, Agent, or Firm* — Andrew Wilford

(57) ABSTRACT

The invention relates to a mechanical switch contact (10) for releasing, disconnecting, or switching over, in particular for an on-load tap changer of a step transformer, comprising at least two contact fingers or contact finger blocks (12, 14), which can each be pivoted between two end positions and which are connected to each other in an electrically conductive manner and which are each operatively connected to a rotatable switching shaft (18) by means of multi-arm joints (16), said switching shaft having all-around guide slots (24) for actuating the multi-arm joints (16) and for thereby deflecting the contact fingers or contact finger blocks (12, 14).

10 Claims, 4 Drawing Sheets

MECHANICAL SWITCH CONTACT

CROSS REFERENCE TO RELATED APPLICATIONS

This application is the US-national stage of PCT application PCT/EP2011/000854 filed 23 Feb. 2011, published 20 Oct. 2011 as WO2011/128012, and claiming the priority of German patent application 102010015051.7 itself filed 15 Apr. 2010.

FIELD OF THE INVENTION

The present invention relates to a mechanical switch contact for switching over or releasing or separating an electrical contact, particularly in a load changeover switch of a tap changer

BACKGROUND OF THE INVENTION

Known load changeover switches for tap changers of regulating transformers usually have a so-called resistance fast changeover switching, the switching contact shafts of which are controlled by a cam disk transmission that in turn is driven by an energy store. In that regard, the cam disk moves in an oscillating motion between two end positions and, in particular, in dependence on the respective direction of movement of the selector. This means that the contacts that have closed first in the case of a first rotational direction of the cam disk open first when a return movement takes place. The contacts that have opened first in the same rotational direction of the cam disk close last when the return movement takes place.

DE 100 50 821 C1 discloses a mechanical switch contact for double-pole interruption for a tap changer. The switch contact comprises an insulating material carrier on which are arranged fixed contacts that are constructed as spherically shaped contact regions. In addition, rotatably mounted on the insulating material carrier is a contact carrier that is connected with a pivot arm pivotable through a defined angle. A contact member is fastened to the free end of the pivot arm and has in turn contact rollers at its two ends. The fixed contacts are selectably electrically connectable by these contact rollers. Depending on the respective position of the pivot arm the contact rollers impinge on the spherical surface of respective oppositely arranged fixed contacts and in this manner produce respective electrical contact connections.

A further mechanical switch contact for switching over in an on-load tap changer is known from WO 2007/042088 A1. This mechanical switch contact also has an insulating material carrier at which fixed contacts, with which electrical connection can be made, are arranged. In addition, rotatably mounted on the insulating material carrier is a switch lever that has a pivot arm at one of its two free ends and an actuating profile at the other free end. The switch lever is, in the case of action of force on the actuating profile, abruptly pivotable from one of its two stationary states into the respective other stationary state. A contact housing pivotable about a separate bearing is additionally mounted on the insulating material carrier and carries two parallel, electrically interconnected contact fingers that respectively surround at both sides the electrically connected fixed contacts. The contact housing is disposed in mechanical connection with the switch lever and is actuatable by this. The switch lever can in addition comprise an entrainer that mechanically positively engages in an entrainer opening of the contact housing. One of the two fixed contacts can be selectably constructed as a contact rail, on which the contact fingers slide during movements of the contact housing.

It is common to the actuating mechanisms for known mechanical switch contacts for switching over in on-load tap changers that the switching over takes place between two end positions so that oscillating switching movements are required.

WO 898/08924 A discloses a spring jump drive for load changeover switches of tap changers, the storage spring of which can be stressed by a drive, the shaft of which rotates either in or counter to clockwise sense, wherein an element, which is driven by the storage spring during the switching-over process, for the contact movement executes a rotational movement. The element for contact movement can be, for example, a cam disk or a gate control. The storage spring and the driven element are connected with a coupling element that is rotatable only in one direction regardless of the rotational direction of the drive. This known spring jump drive serves for contact sequence control and is particularly suitable for thyristor load changeover switches.

OBJECT OF THE INVENTION

An object of the present invention consists in proposing a reliably operating mechanical switch contact that allows a mechanically and electrically secure contact-making between two end positions regardless of a rotational direction of an actuating shaft.

SUMMARY OF THE INVENTION

In order to achieve the object the present invention proposes a mechanical switch contact for contact-making, contact separation or switching over that can be used particularly in the case of an on-load tap changer of a tapped transformer. The mechanical switch contact comprises at least two electrically conductively interconnected contacts or contact subassemblies or contact finger blocks that are movable independently of one another and respectively pivotable between two end positions and that are operatively connected by way of multi-lever linkages with a rotatable switching shaft having annular cams for actuation of the multi-lever linkages and for deflection, which is coupled therewith, of the contacts or contact subassemblies.

This mechanical switch contact according to the invention is constructed as a release switch or changeover switch and serves for reliable mechanical and electrical switching over under high load, for example in a tapped transformer. The two pivotable contacts or contact finger blocks are in that case preferably mounted on an electrically conductive common axle arranged parallel to the rotatable switching shaft. The contacts or contact finger blocks can, however, selectably also be mounted differently therefrom, for example perpendicularly to the axle. In addition, a separate mechanical, electrically conductive abutment, which is constructed as a contact, for forming the respectively connected end positions of the release switch, separating switch or changeover switch is associated with each of the two pivotable contact subassemblies or contact finger blocks.

The mechanical switch contact according to the invention provides a reliably operating electrical separating or changeover switch, the switching fingers of which are driven with constrained guidance by way of a rotating gate cam or disk and accordingly can be controlled very precisely and reliably, and, in particular, in correspondence with the form of the cam independently of the rotational direction of the gate cam or disc. In many instances of use it is particularly advantageous if use can be made not of an oscillating drive, but of a rotating, optionally even directionally independent, actuating movement for the release switch or changeover switch as is in the case, for example, with known tap changers or load switches or the like in the heavy-current field.

Moreover, provision can be made for the first contact subassembly or first contact finger block in a first end position of the mechanical switch contact to bear against the electrically conductive mechanical abutment thereof and to produce an electrically conductive connection between the electrically conductive common axle and the abutment, while the second contact subassembly or the second contact finger block is raised from the electrically conductive mechanical abutment associated therewith. Through the independent pivotation of the two contact finger blocks it can be ensured that a switching-over action is made possible without simultaneous contacting of the two connections to be switched. Thus, the first contact finger block in the second end position of the mechanical switch contact is raised from the electrically conductive mechanical abutment associated therewith, while the second contact finger block bears against the electrically conductive mechanical abutment associated therewith and produces an electrically conductive connection between the electrically conductive common axle and the abutment.

The contact finger blocks are pivoted in the desired manner between the respective end positions thereof by the switching shaft and the disc-shaped cams, which are connected therewith to be secure against relative rotation, as well as the multi-lever linkages arranged between the contact finger blocks and the cams. The two contact finger blocks are thus selectably mechanically coupled together. Depending on the respective profile of the movement tracks arranged in the disc-shaped cams or cam disks the contact finger blocks are pivotable with a slight delay relative to one another and correspondingly switchable so that during the short switching time initially the conductive contact-making of one contact finger block is closed before the conductive contact-making of the other contact finger block is opened and the individual switching process concluded.

The contact finger blocks or contact subassemblies are actuatable in the mentioned manner independently of the rotational direction of the switching shaft so that in the case of repeated rotational movements this can trigger respectively identical or changing pivot movements of the two contact finger blocks. The cams are preferably respectively arranged in disks connected with the switching shaft to be secure against relative rotation and respectively guide an actuating pin of each of the multi-lever linkages, wherein the pin can be deflected by the correspondingly shaped movement gate or cam when the disks are rotated together with the switching shaft. According to one variant of embodiment of the invention a first lever, which is mounted at one end to be fixed relative to a frame or housing, of each multi-lever linkage can have a pin sliding in the cam and be coupled at its free end with a second lever that pivotably engages the contact finger. The pin is preferably arranged between the mounting, which is fixed relative to the frame or housing, and the free end of the first lever so that even with small deflections of the cam a sufficient lever movement can be achieved adequate for pivotation of the respective contact finger block.

The two contact finger blocks or contact subassemblies can be actuated in the mentioned manner multiple times as separating switch, release switch or changeover switch without the rotational direction of the switching shaft being changed. The mechanical switch or changeover switch according to the invention can thus continue to switch several times in one direction. The switching shaft can be coupled by way of, for example, a step transmission to a rotational drive that is present so that a fixed phase association can be ensured.

It may be additionally mentioned that through a suitable format and design of the cams of the cam disks almost any desired switching angles and switching ramps can be achieved, not only for the opening travel of the contacts, but also with respect to the rotational angle of the drive shaft.

A variant, which is not explained in more detail here, additionally provides a three-phase arrangement that similarly can be realized. In the case of such a three-phase arrangement several contact finger blocks can be mounted on common articulated axles so that they divide the respective articulated axles.

BRIEF DESCRIPTION OF THE DRAWING

The invention is explained in more detail in the following by way of embodiments with use of the drawings that are described in the following and in which.

SPECIFIC DESCRIPTION OF THE INVENTION

Figure 1:
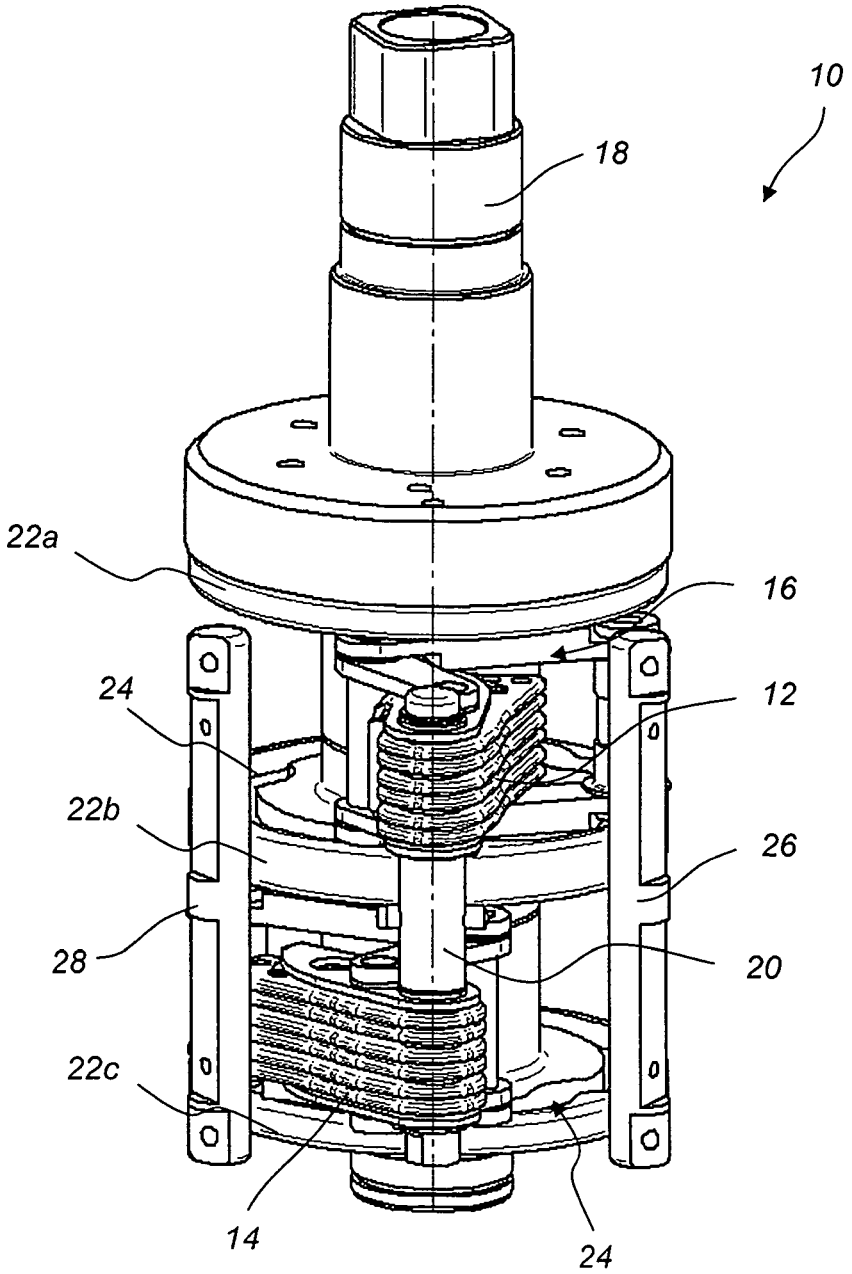
FIG. 1 is a schematic perspective view of a variant of embodiment of a mechanical switch contact according to the invention.

The embodiment described in the following is not to be understood restrictively, but serves for explanation of the function of a mechanical switch contact according to the invention. The schematic illustrations of FIGS. 1 to 4 show a mechanical switch contact 10 for switching over that can be used particularly in an on-load tap changer of a tapped transformer. The mechanical switch contact 10 illustrated by way of an exemplifying embodiment comprises two electrically conductively interconnected contact fingers 12 and 14 that are respectively pivotable between two end positions and that are respectively operatively connected by way of multi-lever linkages 16 with a rotatable switching shaft 18. Several cam disks 22*a*, 22*b*, 22*c* that respectively serve for guidance and movement of the multi-lever linkages 16, are arranged at the switching shaft 18 above and below the contact fingers 12 and 14 that are pivotably mounted on a common electrically conductive axle 20 as well as between these fingers. For this purpose, the cam disks 22*a*, 22*b*, 22*c* have respective encircling cams 24 serving for guidance of the multi-lever linkages 16 and thus for deflection, which is coupled therewith, of the contact fingers 12 and 14.

The illustrated mechanical switch contact 10 is constructed as a changeover switch or as a release switch, for which reason the two pivotable contact fingers 12 and 14 are electrically conductively connected and mounted on the common axle 20. The axle 20 is arranged parallel to the rotatable switching shaft 18. A separate mechanical electrically conductive abutment 26 and 28 for forming the respective connected end positions of the changeover switch is in addition associated with each of the two pivotable contact fingers 12 and 14. Thus, the upper contact finger 12 has a first abutment 26 against that it electrically conductively bears in a first switch setting so that an electrically conductive connection between the axle 20 and the first abutment 26 is produced. Associated with the lower contact finger 14 is the second abutment 28, against which it electrically conductively bears in a second switch setting so that an electrically conductive connection between the axle 20 and the second abutment 28 is produced. In the second switch setting illustrated in FIGS. 1 to 4 the first contact finger 12 is raised from the first abutment 26, while the second contact finger 14 bears against the second abutment 28. During a switching-over process (not illustrated here) the two contact fingers 12 and 13 by contrast temporarily bear against their corresponding contact abutments 26 and 28, respectively, so that the changeover switch has temporarily closed both contacts.

Through rotation of the switching shaft 18 in any direction and the rotation, which is coupled therewith, of the cam disks 22 and the cams 24 arranged therein as well as through the pivot movements, which are triggered thereby, of the multi-lever linkages 16 arranged between the contact fingers 12, 14 and the cams 24 the contact fingers 12 and 14 are pivoted in the desired manner between the respective end positions thereof. The two contact fingers 12 and 14 are mechanically coupled together by way of the cams 24. Depending on the respective profile of the cams 24 arranged in the cam disks 22 and the thereby-formed movement paths the contact fingers 12 and 14 are pivotable with a slight delay relative to one another and correspondingly switchable so that during the short switching time initially the conductive contact-making of one contact finger 12 is closed before the conductive contact-making of the other contact finger 14 is opened and the individual switching process concluded.

Figure 2:
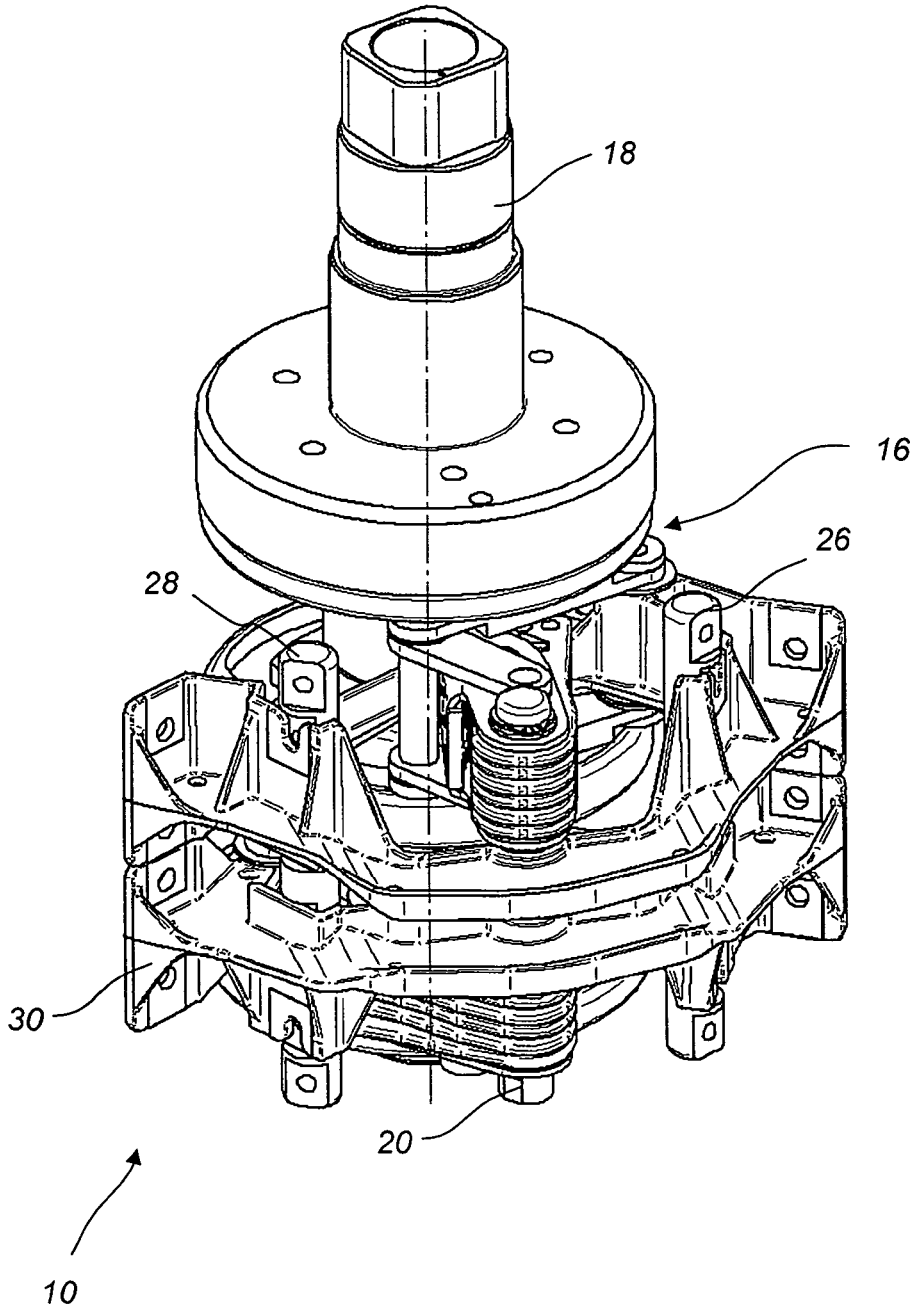
FIG. 2 is a further illustration of the mechanical switch contact according to FIG. 1.
Figure 3:
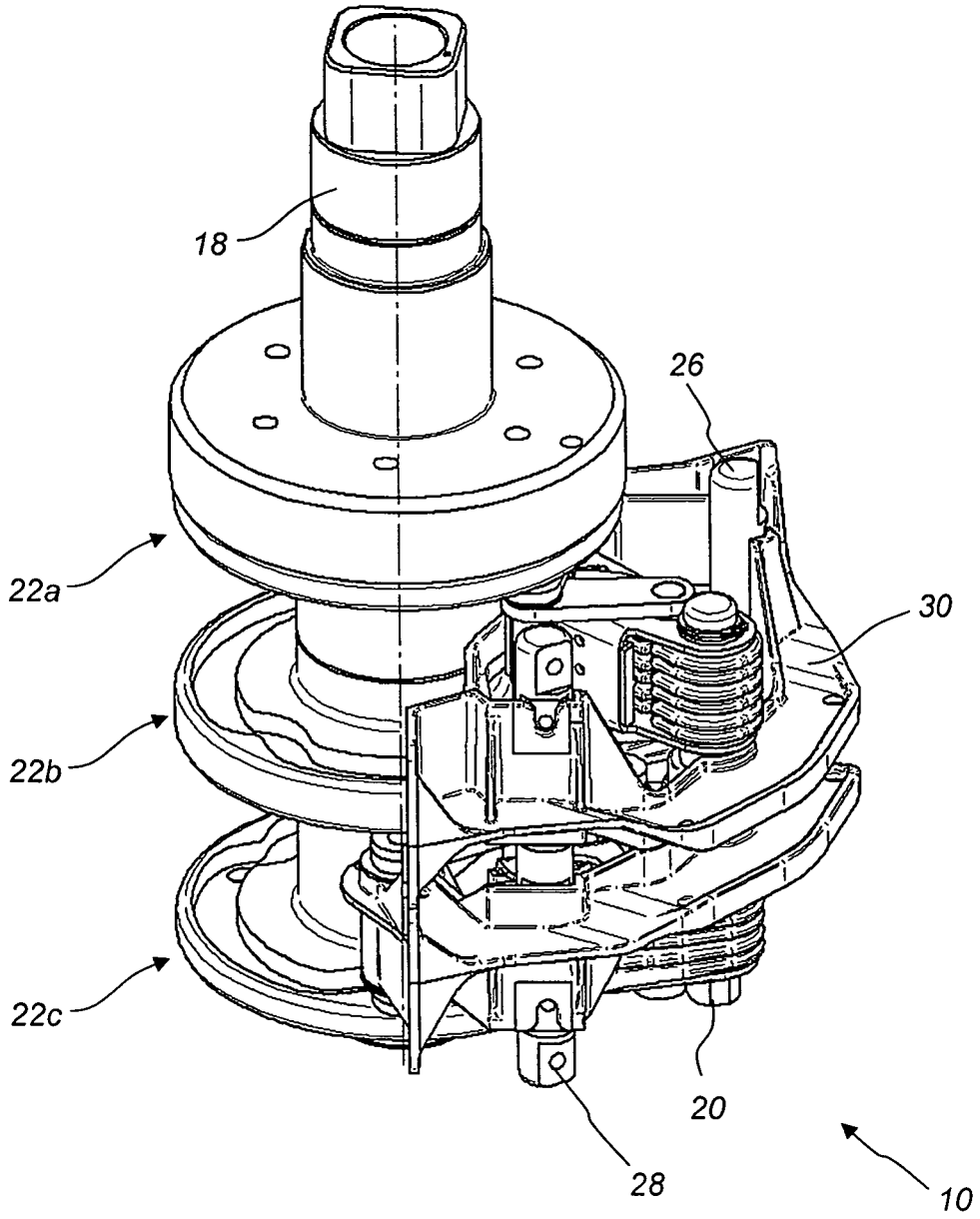
FIG. 3 is another view of the switch contact according to FIG. 2
Figure 4:
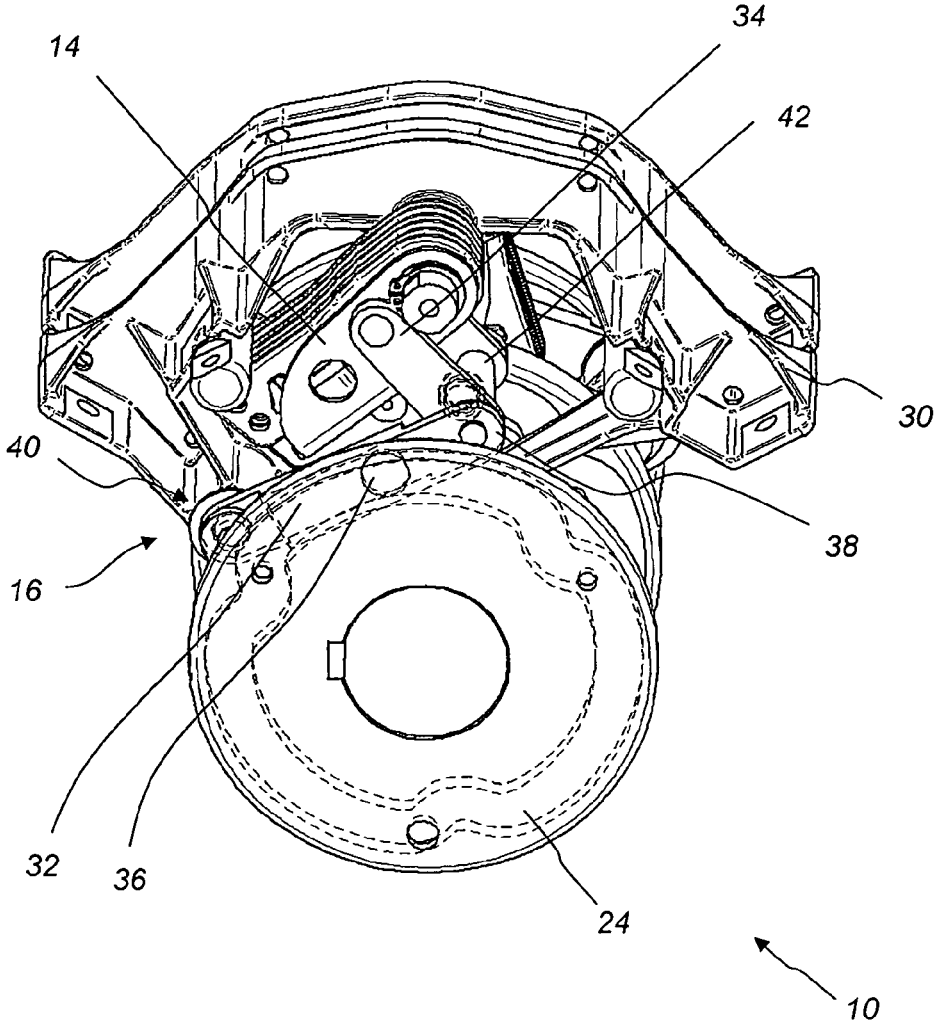
FIG. 4 is a third view of the switch contact according to FIG. 2.

The fastening frames 30 shown in FIGS. 2 to 4 serve for fixing and mounting the axle 20 and the abutments 26 and 28 as well as the movable parts connected therewith or mounted thereon. The movements of the multi-lever linkages 16 are, in particular, clarified by way of FIG. 4, which linkages are formed from a plurality of interconnected levers 32 and 34. A longer lever 32, which is mounted to be fixed relative to the frame or housing, of each multi-lever linkage 16 has a pin 36 that slides in the cam 24 and that is arranged closer to its free end 38 than to its pivotable fixing to the fastening frame 30. Mounted on the free end 38 of the long lever 21 by way of an axle 42 is a short lever 34 that at its other end pivotably engages the contact finger 14. The pin 36 is so placed between the mount 40 that is fixed relative to the frame or housing, and the free end 38 of the long lever 32 that even with small deflections of the cam 24 a sufficient lever movement can be achieved adequate for pivotation of the contact finger 14. The upper contact finger 12 is in corresponding manner coupled by an identically constructed and dimensioned multi-lever linkage 16 with the cam 24 associated therewith so that through identical cams 24, which are offset relative to one another in rotational direction, the desired offset pivot movements of the two contact fingers 12 and 14 can be triggered.

The contact fingers 12 and 14 are actuatable independently of the rotational direction of the switching shaft 18 in the illustrated manner so that the switching shaft 18 in the case of repeated rotational movements triggers respectively identical pivot movements of the two contact fingers 12 and 14. The mechanical switch contact 10 according to the invention provides a reliably operating mechanical changeover switch, the switching fingers 12, 14 of which are constrainedly guided by way of the rotating shaft 18 and the cam disks 22 and accordingly can be controlled very precisely and reliably and, in particular, independently of the rotational direction of the shaft.

The two contact fingers 12 and 14 can be actuated in the illustrated manner multiple times as release switch, separating switch or changeover switch without the rotational direction of the switching shaft 18 being changed. The mechanical changeover switch according to the invention can thus continue to switch a plurality of times in one direction or switch back and forth. The switching shaft 18 can, for example, be coupled by way of a step transmission to a rotational drive, which is present, so that a fixed phase association can be ensured.

The invention claimed is:

1. A mechanical switch contact for releasing, separating or switching over in an on-load tap changer of a tapped transformer, which comprises at least two electrically conductively interconnected contact fingers or contact finger blocks movable independently of each other and respectively pivotable between two end positions and which are respectively operatively connected by multi-lever linkages with a rotatable switching shaft, having annular cams coupled to and serving for actuation of the multi-lever linkages and for deflection of the contact fingers or contact finger blocks.

2. The mechanical switch contact according to claim 1, wherein the two pivotable contact fingers or contact finger blocks are mounted on an electrically conductive common axle and a separate mechanical electrically conductive abutment for forming the respectively connected end positions of the separating switch, release switch or changeover switch is associated with each of the two pivotable contact fingers or contact finger blocks.

3. The mechanical switch contact according to claim 1, wherein the first contact finger or the first contact finger block in a first end position of the mechanical switch contact bears against its electrically conductive mechanical abutment and produces an electrically conductive connection between the electrically conductive common axle and the abutment, whereas the second contact finger or the second contact finger block is raised from the electrically conductive mechanical abutment associated therewith.

4. The mechanical switch contact according to claim 3, wherein the first contact finger or the first contact finger block in the second end position of the mechanical switch contact is raised from the electrically conductive mechanical abutment associated therewith, whereas the second contact finger or the second contact finger block bears against the electrically conductive mechanical abutment associated therewith and produces an electrically conductive connection between the electrically conductive common axle and the abutment.

5. The mechanical switch contact according to claim 4, wherein the two contact fingers or contact finger blocks are mechanically coupled together and actuatable or pivotable and thereby switchable slightly delayed relative to one another.

6. The mechanical switch contact according to claim 1, wherein the cams are respectively arranged in cam disks connected with the switching shaft to be secure against rotation relative thereto and respectively guide and deflect an actuating pin of each of the multi-lever linkages.

7. The mechanical switch contact according to claim 6, wherein a first lever, which is mounted at one end to be fixed relative to a frame or housing, of each multi-lever linkage comprises a pin sliding in the cam and is coupled at its free end with a second lever, which pivotably engages the contact finger or the contact finger block.

8. The mechanical switch contact according to claim 7, wherein the pin is arranged between the mounting fixed relative to the frame or housing and the free end of the first lever.

9. The mechanical switch contact according to claim 1, wherein the contact fingers or finger blocks are actuatable independently of the rotational direction of the switching shaft, in case of repeated rotational movements, this shaft triggers respective identical pivot movements of the two contact fingers or finger blocks.

10. A mechanical switch contact for releasing, separating or switching in an on-load tap changer of a tapped transformer, the contact comprising:

at least two interconnected electrically conductively interconnected contact fingers or finger blocks each pivotable between two respective end positions;

a switching shaft rotatable in two opposite directions;

respective cams; and respective multilever linkages between the cams and the contact fingers for, on rotation of the shaft in either direction, pivotally displacing the fingers or finger blocks independently of each other between the respective end positions.

* * * * *